US005605021A

United States Patent [19]

Thomann

[11] Patent Number: 5,605,021

[45] Date of Patent: Feb. 25, 1997

[54] EARTHQUAKE-PROOF BUILDING

[76] Inventor: Bernard Thomann, 56, rue Molitor, 75016 Paris, France

[21] Appl. No.: 307,598

[22] PCT Filed: Jan. 26, 1993

[86] PCT No.: PCT/FR93/00075

§ 371 Date: Mar. 9, 1995

§ 102(e) Date: Mar. 9, 1995

[87] PCT Pub. No.: WO93/19264

PCT Pub. Date: Sep. 30, 1993

[30] Foreign Application Priority Data

Mar. 17, 1992 [FR] France ..... 92 103149

[51] Int. Cl.[6] ..... E02D 27/34

[52] U.S. Cl. ..... 52/167.1; 52/167.5; 52/169.14; 114/346

[58] Field of Search ..... 52/23, 83, 167.1, 52/167.5, 169.14; 114/346, 357

[56] References Cited

U.S. PATENT DOCUMENTS

| | | | |
|---|---|---|---|
| 1,088,239 | 2/1914 | Paine | 52/167.1 X |
| 2,166,577 | 7/1939 | Beckius | 52/167.1 X |
| 2,573,987 | 11/1951 | Sage | 52/23 |
| 3,916,578 | 11/1975 | Foootan et al. . | |
| 3,968,190 | 7/1976 | Stewart | 52/167.1 X |
| 4,223,506 | 9/1980 | Blair et al. | 52/167.1 X |
| 4,228,788 | 10/1980 | Moeser . | |
| 4,250,671 | 2/1981 | Hirsch et al. | 52/167.1 X |
| 4,271,641 | 6/1981 | Kawaguchi . | |
| 4,315,385 | 2/1982 | Moreau et al. | 52/167.1 X |
| 4,633,629 | 1/1987 | Britz | 52/167.1 X |
| 5,325,642 | 7/1994 | Cooley | 52/167.1 X |
| 5,444,943 | 8/1995 | Schelfhorst | 52/83 X |

FOREIGN PATENT DOCUMENTS

| | | | |
|---|---|---|---|
| 2542032 | 9/1984 | France | 52/167.1 |
| 8431729.9 | 8/1987 | Germany . | |
| 1270271 | 11/1986 | U.S.S.R. | 52/167.1 |
| 1717776 | 3/1992 | U.S.S.R. | 52/167.1 |

*Primary Examiner*—Wynn E. Wood
*Assistant Examiner*—Aimee E. McTigue
*Attorney, Agent, or Firm*—Wolf, Greenfield & Sacks, P.C.

[57] ABSTRACT

Earthquake-proof building, characterized in that it is composed of a circular horizontal base structure (1) obtained by joined-together elements juxtaposed along radii, a vertical storey structure (2) comprising pillars (9, 10) arranged bearing on this horizontal base structure, a circular roof structure (3) arranged bearing on the pillars, tensioned cables (6, 19) being arranged on the one hand in a horizontal plane in order to encircle the circular base structure, on the other hand in vertical planes pointing radially in order to surround the building from the periphery of the base structure, passing through the roof structure.

18 Claims, 6 Drawing Sheets

EARTHQUAKE-PROOF BUILDING

The present invention relates to an earthquake-proof building.

Various earthquake-proof buildings are already known, particularly from documents:

U.S. Pat. No. 4,228,788 (MOESER)

U.S. Pat. No. 3,916,578 (FOROOTAN ET AL.)

U.S. Pat. No. 4,271,641 (KAWAGUCHI)

DE-U-8,431,729 (IBP PLANUNGS)

but the various solutions known from these documents are complicated and apparently of only relative effectiveness.

The present invention proposes to create an earthquake-proof building which also provides protection against other phenomena or catastrophes, particularly natural ones which are often connected with earth tremors such as fires or flooding.

The solution to this problem is an earthquake-proof building as defined in the first claim.

The other claims relate to characteristics and beneficial developments of the characteristics of the main claim.

Figure 1:
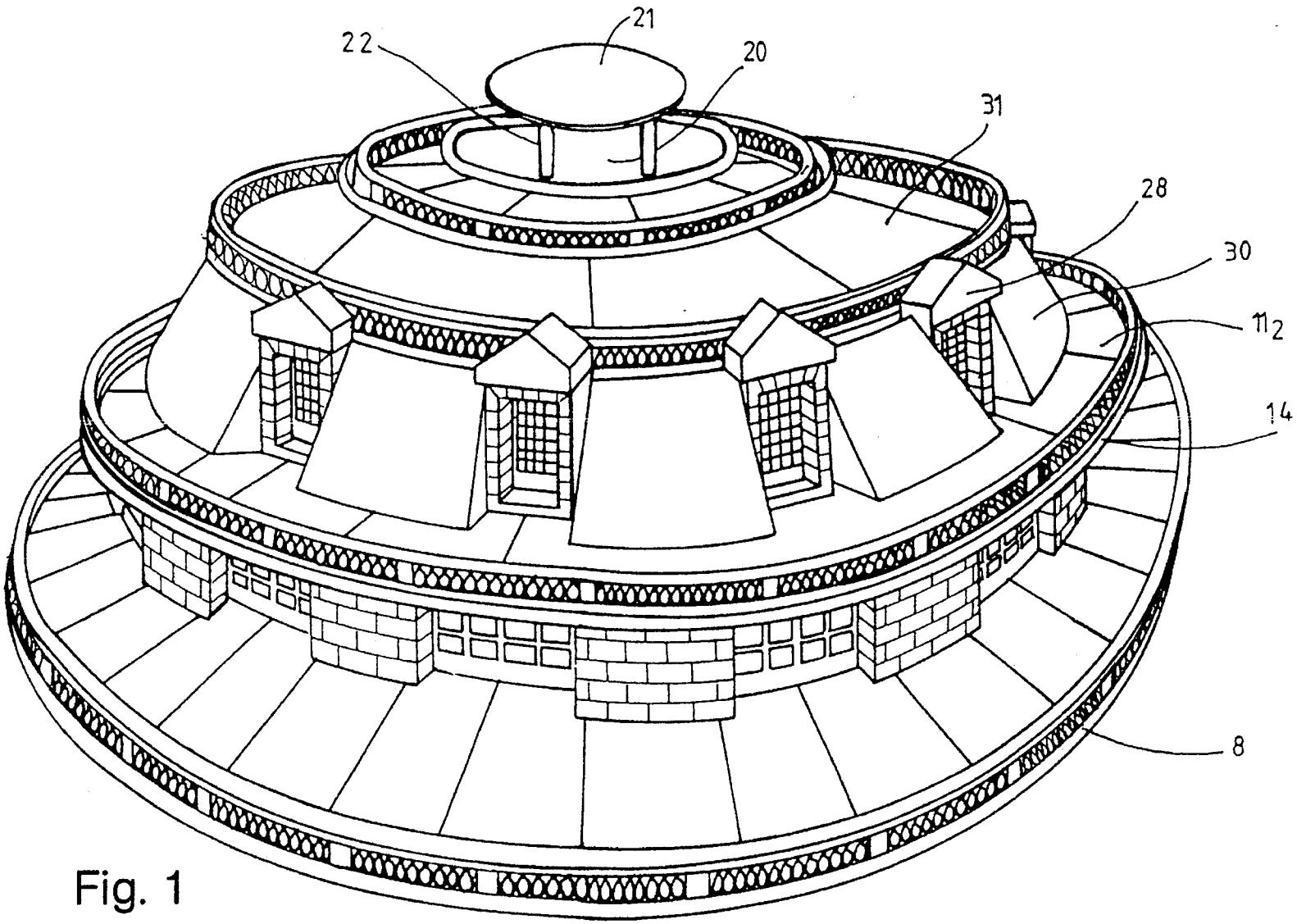
Figure 2:
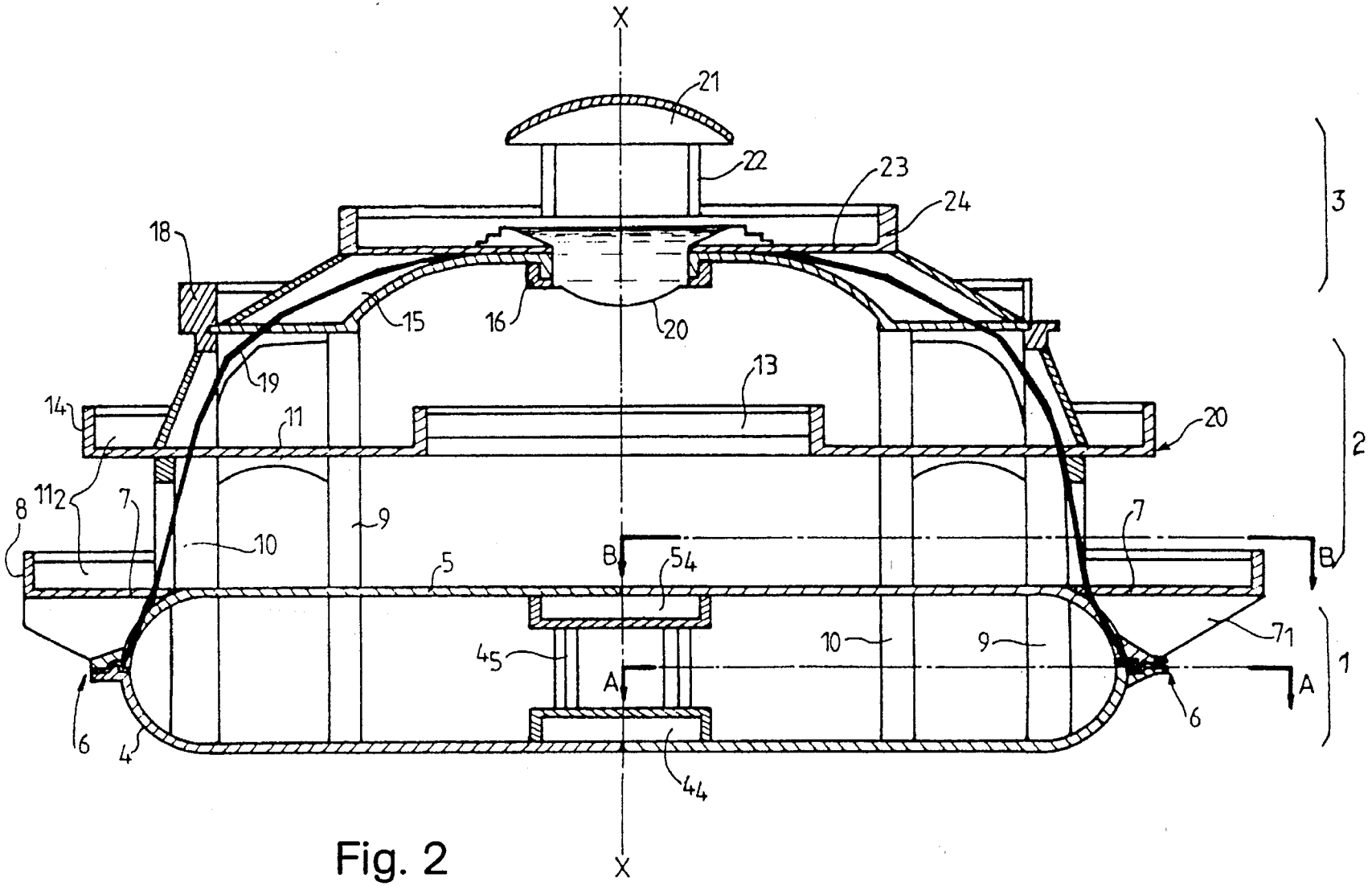
Figure 3:
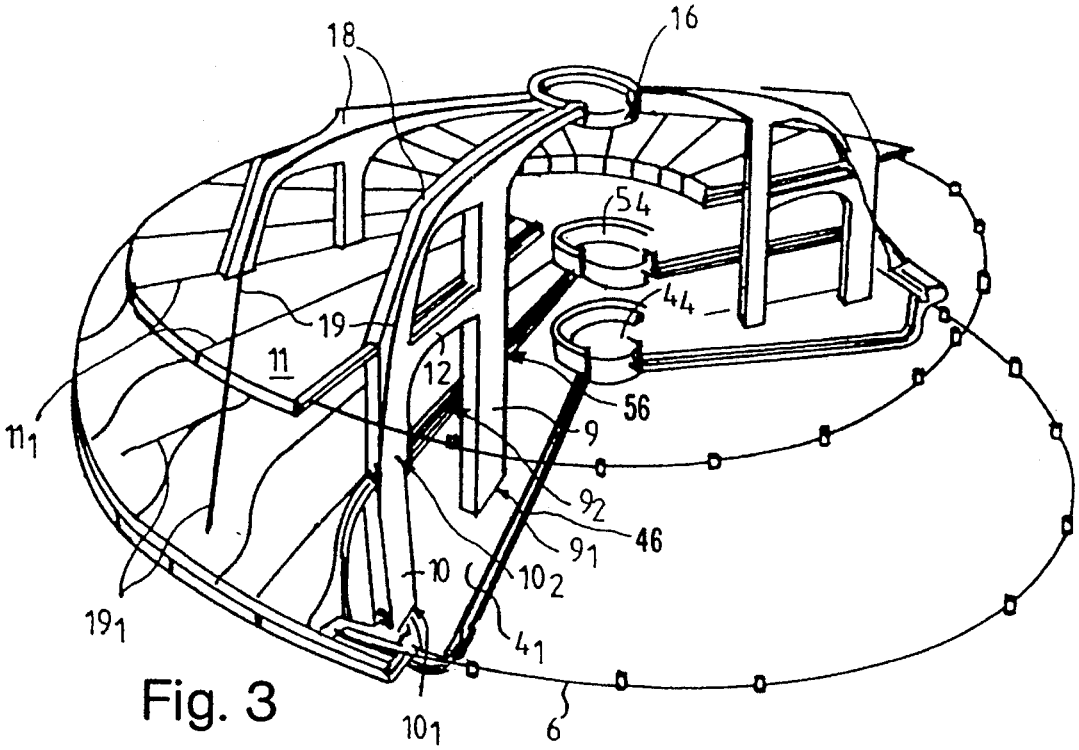
Figure 4:
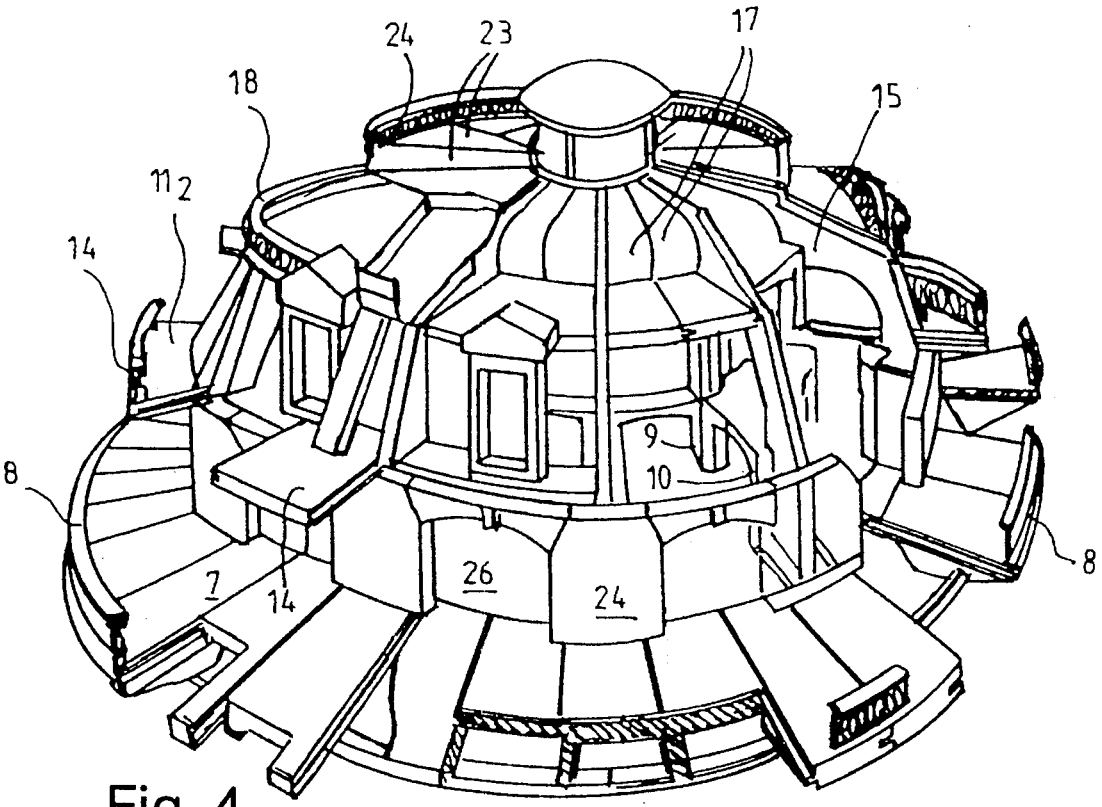
Figure 5:
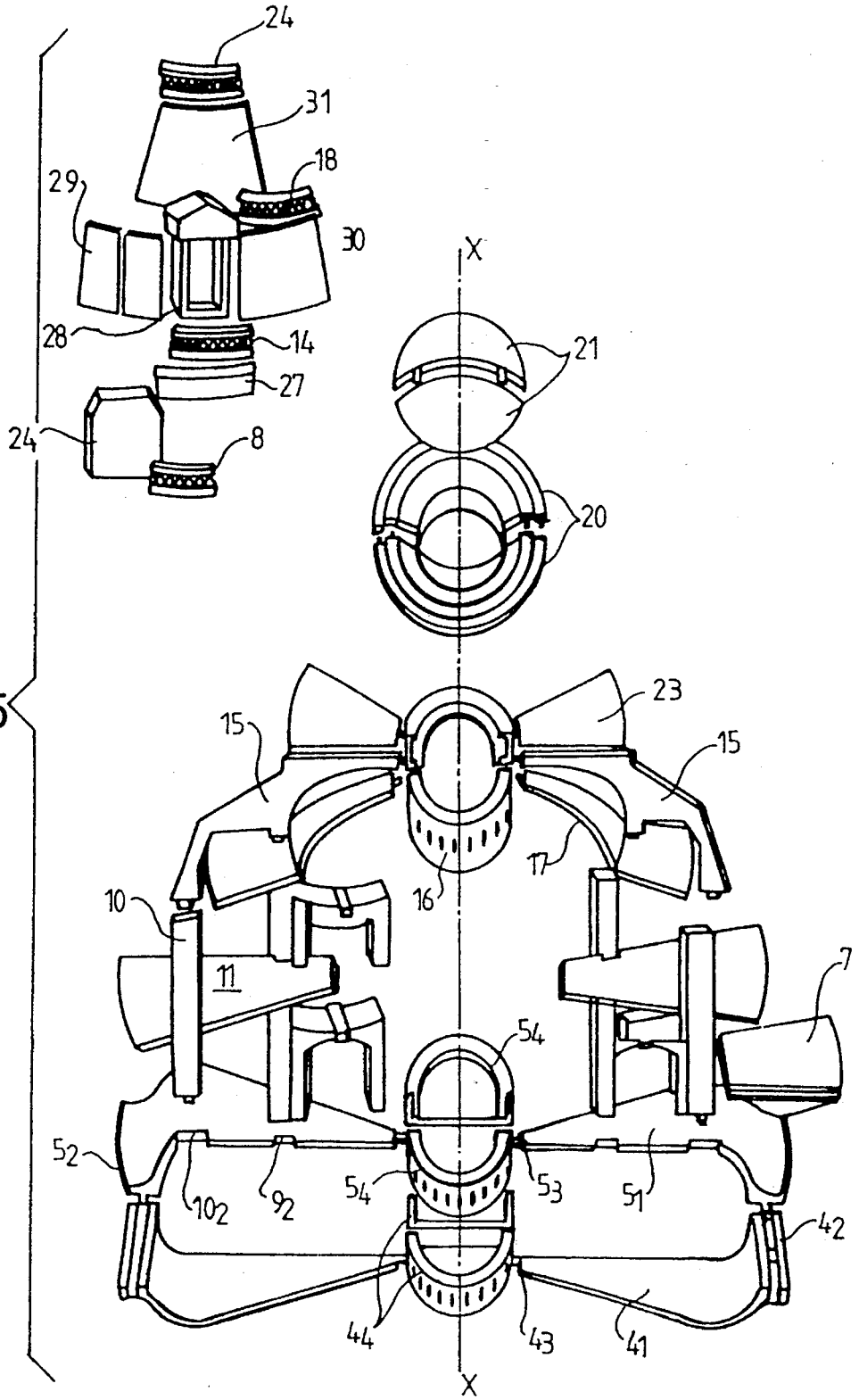
Figure 6:
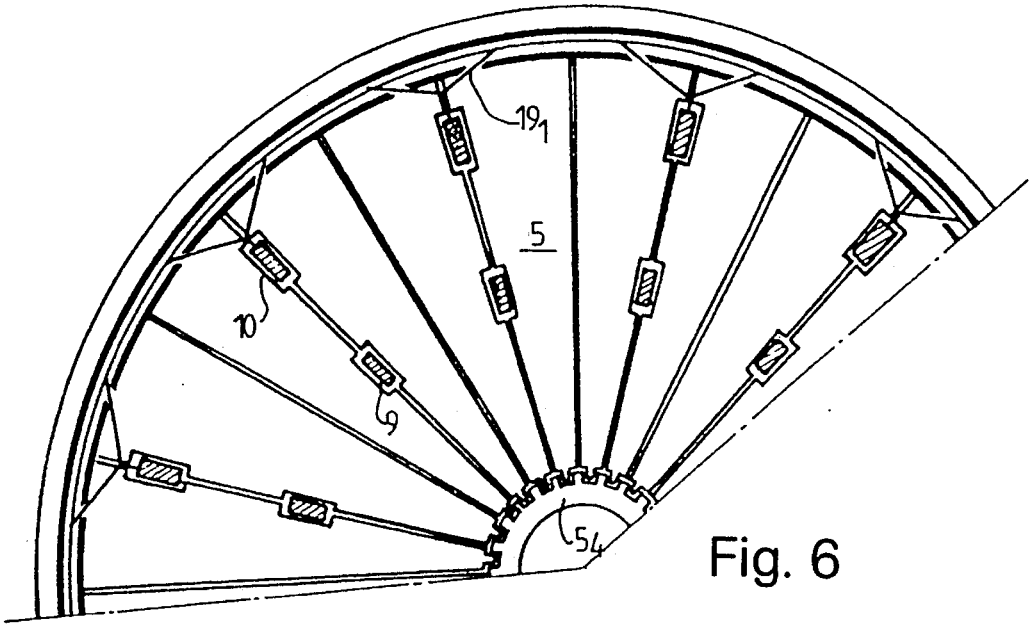
Figure 7:
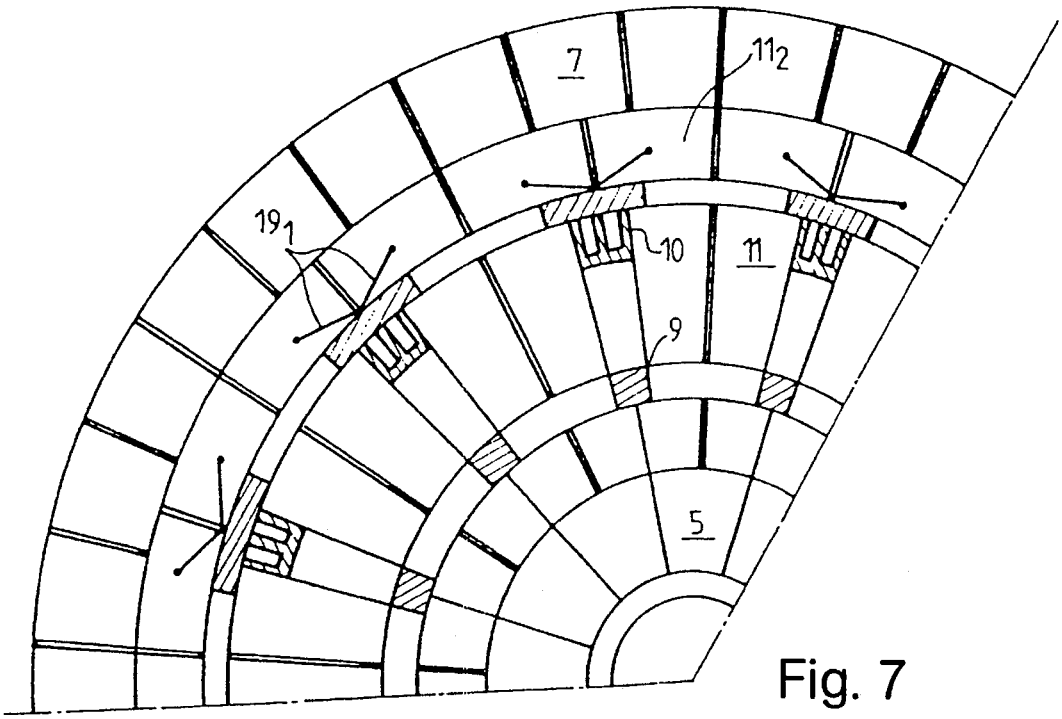
Figure 8:
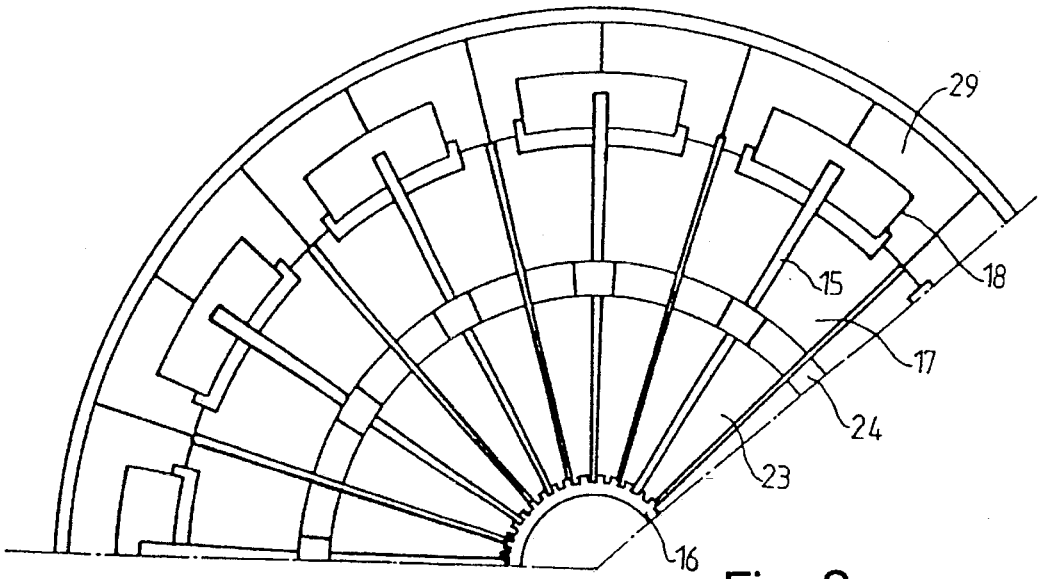
Figure 9:
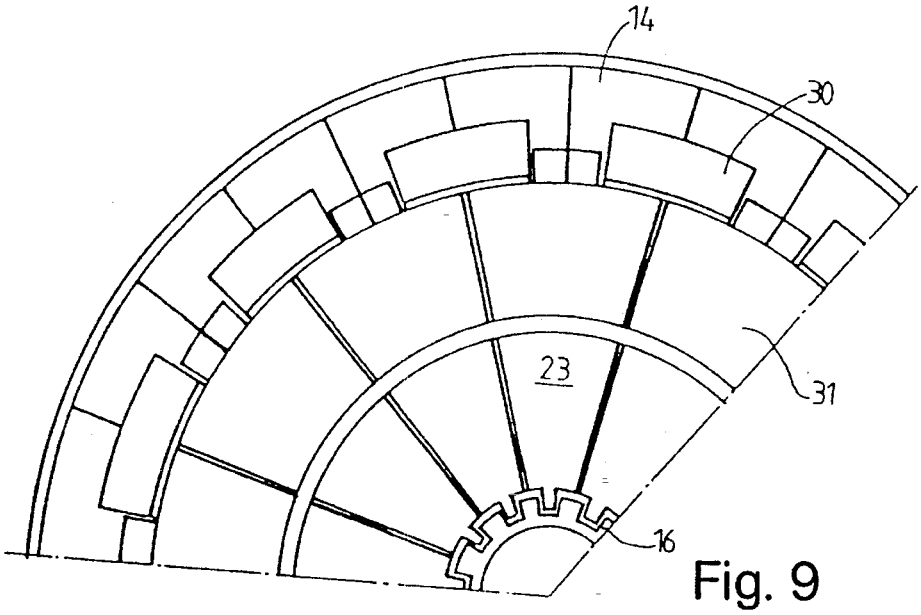

The invention is represented by way of non-limiting example in the appended drawings in which:

FIG. 1 is a view in diagrammatic perspective of an earthquake-proof building in accordance with the invention, FIG. 2 is an axial section of FIG. 1, FIG. 3 is a partially cut-away view in perspective of the skeleton of the building of FIGS. 1 and 2, FIG. 4 is a partially cut-away view in perspective of the building of FIGS. 1 and 2, FIG. 5 represents, in an exploded view, the main elements which enter into the construction of the building of FIGS. 1 and 2, FIGS. 6 and 7 are views in partial section on A—A and B—B of FIG. 2, FIG. 8 is a partial plan view of FIG. 3, FIG. 9 is a partial plan view of FIG. 4.

The building in accordance with the invention diagrammatically comprises a circular horizontal base structure 1, a vertical storey structure 2 forming, in the example represented, a single storey and a circular roof structure 3 of convex overall shape.

According to the example represented, the circular, horizontal base structure is composed of two identical dish elements 4 and 5 each produced with the aid of joined-together identical elements $\mathbf{4}_1$, $\mathbf{5}_1$ in the shape of sectors of a circle, with raised-up edge. These elements are juxtaposed along radii of this circular base structure, the centre of which is situated on the vertical axis X—X of the building.

The two dish elements 4 and 5 which are inverted with respect to one another bear on each other via their periphery with a joggle joint, the elements $\mathbf{4}_1$, $\mathbf{5}_1$ for this purpose including, on their raised-up edge, identical half-joggles $\mathbf{4}_2$, $\mathbf{5}_2$ (see FIG. 5).

Moreover, these juxtaposed elements $\mathbf{4}_1$ and $\mathbf{5}_1$ are joined together by joggles $\mathbf{4}_6$, $\mathbf{5}_6$ located along their planes of radial juxtaposition (see FIG. 3).

The centre end $\mathbf{4}_3$, $\mathbf{5}_3$ of the juxtaposed elements $\mathbf{4}_1$, $\mathbf{5}_1$ of the two inverted dish elements 4 and 5 are joined, by a tenon and mortice fitting, onto circular rings $\mathbf{4}_4$, $\mathbf{5}_4$, themselves each produced as two half-rings (see FIG. 5)

Pillars $\mathbf{4}_5$ support the ring $\mathbf{5}_4$, bearing on the lower ring $\mathbf{4}_4$ (see FIG. 2).

The base structure thus produced constitutes a leaktight structure of which the resistance to earth tremors is obtained particularly by means of a cable 6 arranged under tension and horizontally encircling this base structure 1 at the height of the peripheral joining plane of the two dish elements 4 and 5.

The coaxial rings $\mathbf{4}_4$, $\mathbf{5}_4$ are themselves encircled by a tensioned cable.

The upper face of the second, inverted, dish element 5 constitutes the floor of the ground floor of the building and is extended, on the outside, by floor-terrace elements 7 supported by corbels $\mathbf{7}_1$ and bounded by balustrade elements 8.

The vertical storey structure comprises pillars 9 and 10 and elements 11 forming a storey floor panel.

The pillars 9 and 10 bear via their lower ends at $\mathbf{9}_1$ and $\mathbf{10}_1$ (see FIG. 3), on the middle of elements $\mathbf{4}_1$ of the first dish element 4 and pass through the second dish element 5 at $\mathbf{9}_2$, $\mathbf{10}_2$ at the height of half-joggles formed in the radially-pointing joint planes of the elements $\mathbf{5}_1$. The elements $\mathbf{4}_1$ and $\mathbf{5}_1$ of the two dish elements 4, 5 are therefore angularly offset by an angle corresponding to half the subtended angle of each element.

These pillars 9 and 10 are preferably linked radially to one another by an arch 12 situated directly below the storey floor elements 11.

Preferably, the subtended angle of each element 4, 5 or 11 corresponds to half the subtended angle of the radially-pointing pillars 9, 10 and two juxtaposed elements 5 and 11 as well as an element $\mathbf{4}_1$ juxtaposed on either side with two halves of two other elements $\mathbf{4}_1$ can therefore be found, each time, between two adjacent pillars.

The floor elements 11 which are supported by half-joggles on the pillars 9 and 10 as well as by the arch 12 are coupled in their central zone by an internal balustrade 13, these floor elements 11 extending on the outside of the building in order to form a balcony $\mathbf{11}_2$ delimited by a balustrade 14.

The pillars 9 and 10 are surmounted by roof beams 15 arranged radially and are coupled, at the centre of the building, by a ring 16 which is also encircled by a tensioned cable.

The radial beams 15 support radially juxtaposed joined-together elements 17 which together constitute a cupola ending at the ring 16.

The periphery of the roof structure 3 is delimited by a roof balustrade 18 bearing on the outer pillars 10 and joined to the beams 15 by joggle joints.

Tensioned cables 19 are arranged in vertical planes pointing radially from the periphery of the base structure 1, passing through the roof structure 3, so that by the combined effects of these cables together with the cable 6 horizontally encircling the base structure 1, the end product is a rigid non-deformable structure behaving as if it were monobloc whereas it is actually obtained from a great number of juxtaposed concrete elements, the dimensions of which are preferably defined so that the can be transported by road. The non-deformable structure of the building makes it particularly resistant to earthquakes.

These cables 19 link (see FIG. 2) the periphery of the ring 16 to the periphery of the base structure 1 at the height of each radial assembly formed by the pillars 9, 10 and the beams 15; the end of the cables 19 which are connected to the periphery of the base structure split into $\mathbf{19}_1$ and $\mathbf{19}_2$ so as to be fastened to different elements $\mathbf{4}_1$ of the dish element 4 (see FIG. 6 and 7).

A tensioned cable 20 could equally well be provided in order horizontally to encircle the elements 11 forming the floor of the storey of the building.

Inside the roof ring 16 is arranged a hollow element 20 forming the pool of a swimming pool, this swimming pool being surmounted by a dome 21 supported by pillars 22.

Horizontal panels 23 surrounded by a balustrade 24 are also radially juxtaposed in order to constitute a domed floor (see FIG. 4).

The pool 20 of the swimming pool as well as the dome 21 are preferably both produced in two halves joined together.

The outer face of the earthquake-proof building in accordance with the invention is made up of wall elements 24 (see FIGS. 4 and 5) arranged on either side of openings 26 constituting French doors for the inhabited rooms on the ground floor. These French doors are delimited on the upper edge by lintels 27. At the height of the first floor there are provided window units 28 which are linked by wall panels 29 which are possibly provided with solar collector panels 30.

Such solar collector panels 31 could equally well be provided on top of the skeleton elements 17, together constituting the cupola of the building, As already indicated, this earthquake-proof building is supported by the base structure 1 and more precisely by the first dish element with a leaktight wall 4. It should be noted that this dish element 4 of the base structure 1 could be produced as a volume which is a function of the weight of the building which it supports, in order to constitute a floating building, the waterline of which does not exceed the edge of the dish element 4. The building could thus be arranged to float in the water of a basin, which would particularly make it possible to orientate it permanently with respect to the sun.

I claim:

1. Earthquake-proof building comprising:

a circular horizontal base structure formed from first joined-together elements juxtaposed along radii of the circular base structure to form a first dish element and second joined-together elements juxtaposed along radii of the circular base structure to form a second dish element center of the first dish element being situated on a vertical axis of the building, the second dish element being inverted with respect to the first dish element and having a periphery of the second dish element bearing on a periphery of the first dish element story panels, a vertical story structure including pillars bearing on the horizontal base structure and supporting the story panels, a circular roof structure bearing on the pillars of the story structure, the roof structure being formed from beams and panels which are juxtaposed along a radii of this circular roof, and tensioned cable arranged in a horizontal plane to encircle the circular base structure, and in vertical planes pointing radially to surround the building from periphery of the base structure, passing through the roof structure.

2. Building in accordance with claim 1, wherein the first and second dish elements are joined together by joggles at their periphery.

3. Building in accordance with claim 1, wherein the pillars of the vertical structure are arranged radially with a subtended angle which is twice a subtended angle of the juxtaposed elements.

4. Building in accordance with claim 1, wherein each pillar of the vertical structure bears radially at a middle of one of the first juxtdposed elements of the first dish element of the base structure and passes the second, inverted, dish element to support the second dish element at a height that the second joined-together elements are juxtaposed.

5. Building in accordance with claim 1 wherein the second, inverted, dish element of the base structure forms a floor at an upper face extending radially towards an outside of the dish element by terrace floor elements bearing via a corbela on a border of the second inverted dish element.

6. Building in accordance with claim 1, wherein the circular roof structure includes beams berating on the pillars the beams being arranged along radii of the circular roof structure.

7. Building in accordance with claim 6, wherein the beams of the roof structure are joined to a ring coaxial with the building.

8. Building in accordance with claim 7, wherein the ring is encircled by a tensioned cable.

9. Building in accordance with claim 7, wherein a concave cavity forming a swimming pool is set into the roof ring supported by the beams of the roof structure.

10. Building in accordance with claim 6, wherein the beams of the roof structure support radially juxtaposed, joined-together cupola elements.

11. Building in accordance with claim 1, wherein the tensioned cables arranged radially in vertical planes in order to surround the building from the base structure passing through the roof structure are fastened via one of their ends to the periphery of a ring.

12. Building in accordance with claim 1, wherein the vertical story structure includes pillars supporting a story panel ending in balustrades inside and outside the building.

13. Building in accordance with claim 1, wherein the dish element of the base structure has leaktight walls.

14. Building in accordance with claim 13, wherein the dish element of the base structure is produced having a volume that is a function of the weight of the building which it supports in order to constitute a floating assembly, of which the waterline does not exceed the edge of the dish element.

15. Earthquake-proof building comprising;

a circular horizontal base structure formed from first joined-together elements juxtaposed along radii of the circular base structure and together forming a first dish element, a center Of which is situated on a vertical axis of the building, wherein the joined-together elements which are juxtapose along radii of the circular base structure are joined, by their center end to a circular ring arranged coaxially with the building, story panels, a vertical story structure including pillars bearing on the horizontal base structure and supporting the story panels, a circular roof structure bearing on the pillars of the story structure, the roof structure being formed from beams and panels which are juxtaposed along the radii of this circular roof, and tensioned cables arranged in a horizontal plane to encircle the circular base structure, and in vertical planes pointing radially to surround the building from a periphery of the base structure, passing through the roof structure.

16. Building in accordance with claim 15, wherein the circular ring joined to the juxtaposed elements of at least one of the dish elements of the base structure is encircled by a tensioned cable.

17. Building in accordance with claim 15, wherein the juxtaposed joined-together elements of the two dish elements of the base structure are angularly offset by an angle equal to half a subtended angle of each element.

18. Building in accordance with claim 17, wherein the joined-together elements of the first and second dish elements are identical and joined together at their periphery by half-joggles.

* * * * *